US006651829B1

(12) United States Patent
Prochaska

(10) Patent No.: US 6,651,829 B1
(45) Date of Patent: Nov. 25, 2003

(54) YARD TOOL STORAGE DEVICE

(76) Inventor: Malcolm Prochaska, 811 Brandon Park Pl. NW., Atlanta, GA (US) 30318-1673

( * ) Notice: Subject to any disclaimer, the term of this patent is extended or adjusted under 35 U.S.C. 154(b) by 38 days.

(21) Appl. No.: 10/157,237

(22) Filed: May 30, 2002

(51) Int. Cl.[7] ..... A47F 5/08

(52) U.S. Cl. ..... 211/70.6; 211/65; 211/87.01; D6/553

(58) Field of Search ..... 211/65, 70.6, 87.01, 211/60.1, 66, 63, 88.01; D6/553

(56) References Cited

U.S. PATENT DOCUMENTS 1,109,788 A * 9/1914 Rose
1,915,020 A * 6/1933 Goldstein
2,144,534 A * 1/1939 Hedquist et al.
3,298,532 A 1/1967 Wilcke
5,788,092 A * 8/1998 Teeney ..... 211/70.6
5,810,177 A * 9/1998 Cabiran ..... 211/70.6
5,842,566 A * 12/1998 White ..... 211/65 X
6,041,947 A * 3/2000 Heneveld ..... 211/70.6
D429,071 S * 8/2000 Hurt
6,142,320 A * 11/2000 DeLorean et al. ..... 211/70.6
6,460,709 B1 * 10/2002 Hurt ..... 211/87.01

* cited by examiner

*Primary Examiner*—Robert W. Gibson, Jr.

(57) ABSTRACT

A yard tool storage device having a hollow body with a front surface, back surface, two opposing side surfaces, a top edge and a bottom edge. Defined in the back surface are at least two holes. The holes are used to connect the body to a support surface. Generally long handled tools would then be stored inside the body of the invention with the handles of the tools resting on the ground surface below the hollow body.

5 Claims, 4 Drawing Sheets

YARD TOOL STORAGE DEVICE

BACKGROUND OF THE INVENTION

1. Field of the Invention

The present invention relates to storage devices, in particular to a device for safely storing yard tools.

2. Description of the Related Art

Long handled tools such as brooms, rakes and shovels have become indispensable implements in and around many homes and work places. Unfortunately, storing even a few of these implements can be difficult, cumbersome and even dangerous. Numerous inventors have attempted to address the aforementioned problem, but they have not provided a storage device with the simplicity, versatility or effectiveness of the present invention.

U.S. Pat. No. 3,298,532 to C. Wilke discloses a device for storing articles such as garden and lawn tools. The device has a lid which fits over a conventional trash can. The lid has several holes through which the handles of implements may be inserted, as well as a handle holder situated in the bottom of the can. The, '532 invention can be distinguished from the present invention in that the present invention does not have a lid with holes which could limit access for implements with handles such as snow shovels. The present invention also has no bottom, which prevents the accumulation of dirt and debris.

U.S. Pat. No. 4,947,998 to Smeller discloses an implement organizer. This device is essentially a lid which mounts onto a receptacle. The lid has several holes defined therein through which several implements may be inserted. The '998 invention may be distinguished from the present invention in that the present invention has no lid, nor a bottom.

U.S. Pat. No. 5,092,463 to Dees discloses a tool storage container. The container has an apparatus which is designed to fit into the open top of an appropriate container, and includes a plate member with hooks around its periphery for suspending the member in a horizontal orientation from the upper peripheral rim of the container. The plate has a plurality of openings for receiving the handles of tools. The '463 invention differs from the present invention in that the present invention has no lid, nor a bottom. Also the '463 invention is not designed to be securable to a support structure.

None of the above inventions and patents, taken either singularly or in combination, is seen to describe the instant invention as claimed. Thus a yard tool storage device solving the aforementioned problems is desired.

SUMMARY OF THE INVENTION

The present invention is a yard tool storage device having a tube shaped body with a front surface, back surface, two opposing side surfaces, a top edge and a bottom edge. The body is generally rectangular in cross section with the perimeter of the cross-section decreasing from top edge to the bottom edge. The top and bottom edges of the body are ordinarily rolled toward the outside of the body and function to support the body. Several holes are defined in back surface of the body to allow the body to be bolted or screwed into the a support surface such as a wall.

Once the device is secured to a support surface, implements are inserted inside the device. The device is generally positioned upon the support surface such that the implements extend through the bottom end of the tube shaped body and are supported on a surface, such as a floor. The distance between the floor and the bottom of the tube ordinarily must be sufficient to keep the implements balanced inside the storage device.

Accordingly, it is a principal object of the invention to provide an easy to use device for storing yard tools.

It is another object of the invention to provide a yard tool storage device that will store a variety of tools safely.

It is a further object of the invention to provide a yard tool storage device that will be space efficient.

Still another object of the invention is to provide a yard tool storage device that will not collect the dirt and debris often associated with yard implements.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENTS

Figure 1:
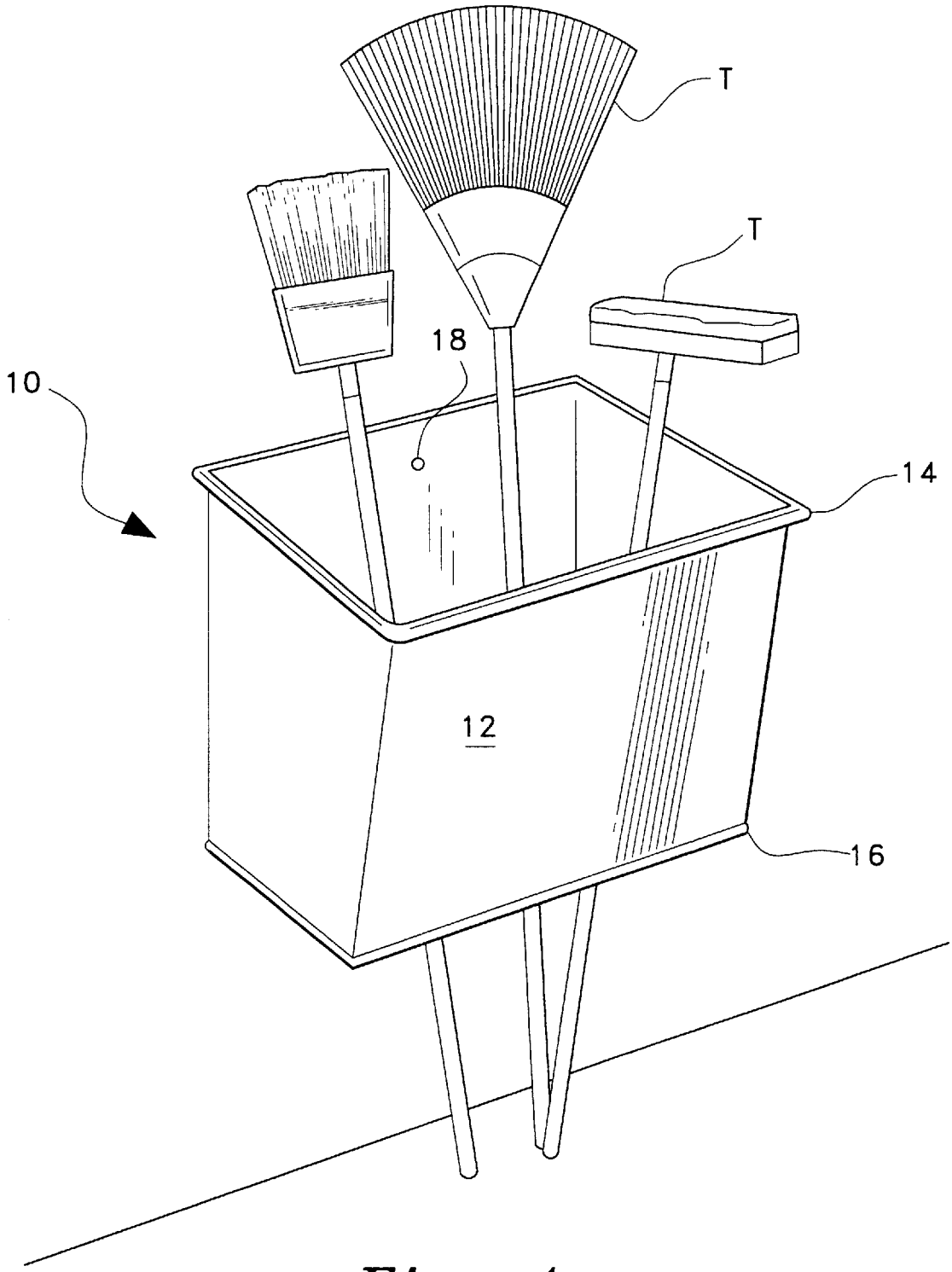
FIG. 1 is an environmental, perspective view of a yard tool storage device according to the present invention.

The yard tool storage device 10 of the present invention, as illustrated in FIG. 1, has a hollow tube shaped body 12 with a front surface, back surface, two opposing side surfaces, a top edge 14 and a bottom edge 16. Ordinarily the body is rectangular in cross-section and its cross-sectional perimeter decreases from the top edge 14 to the bottom edge 16. One skilled in the art could readily alter the shape of the body so long as it remained hollow and was capable of being attached to a support surface. An attachment device, such as screws 18 or nails, extends through holes defined in the back surface of the body 12 and functions to hold the body 12 fixed to a support surface, such as a wall W. When in use, tools T are placed inside the body and extend downward to a bottom surface such as a floor.

Figure 2:
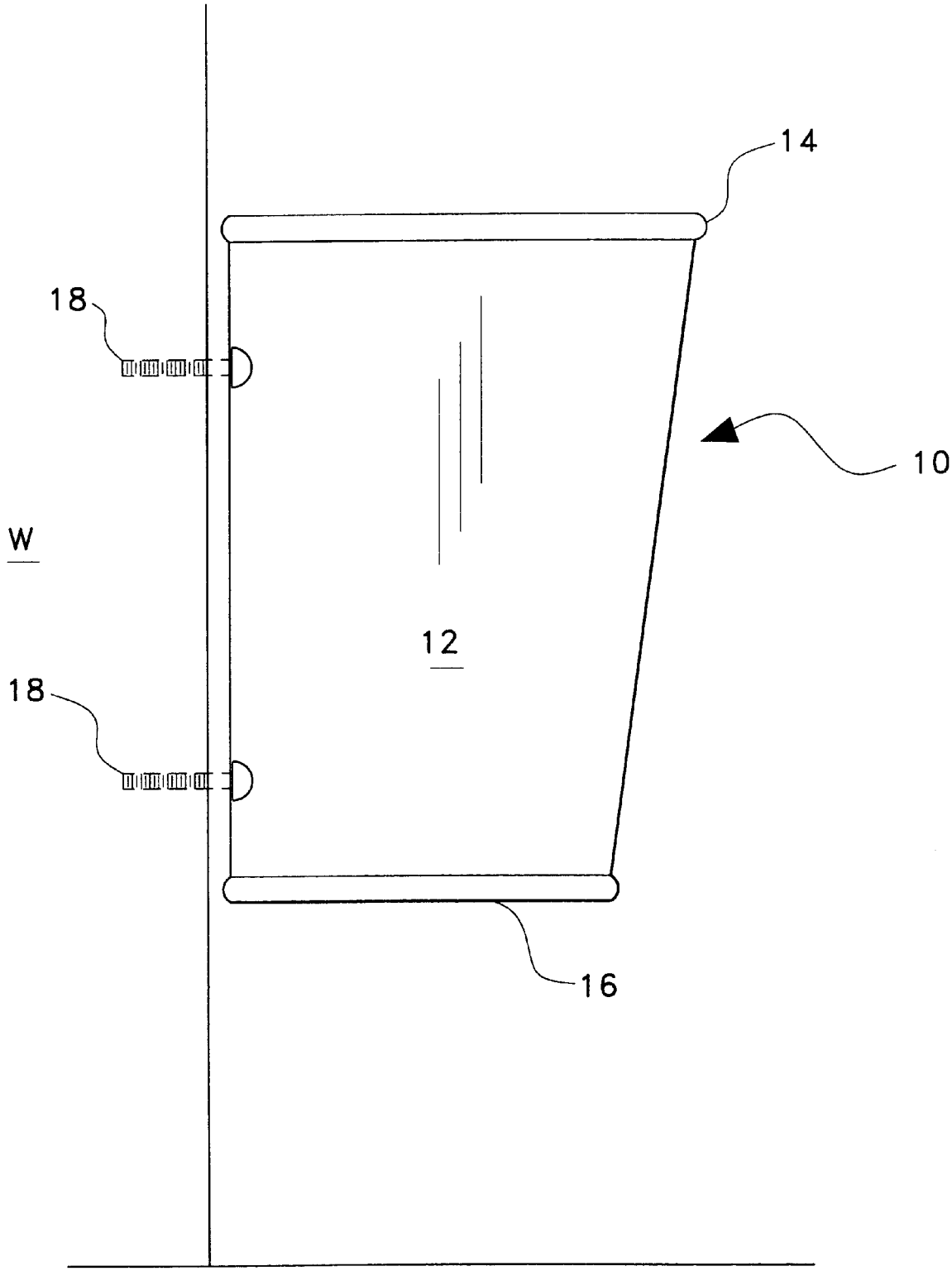
FIG. 2 is a side view of the yard storage device according to the present invention.

FIG. 2 illustrates a side view of the yard tool storage device 10. The body 12 of the invention is secured to a wall W, preferably with screws 18, but nails, bolts and the like may also be used. The screws 18 are ordinarily placed adjacent to the top 14 and bottom 16 edges of the body 12. These edges 14, 16 are ordinarily rolled toward the outside surface of the body and function to enhance the strength of the body 12.

Figure 3:
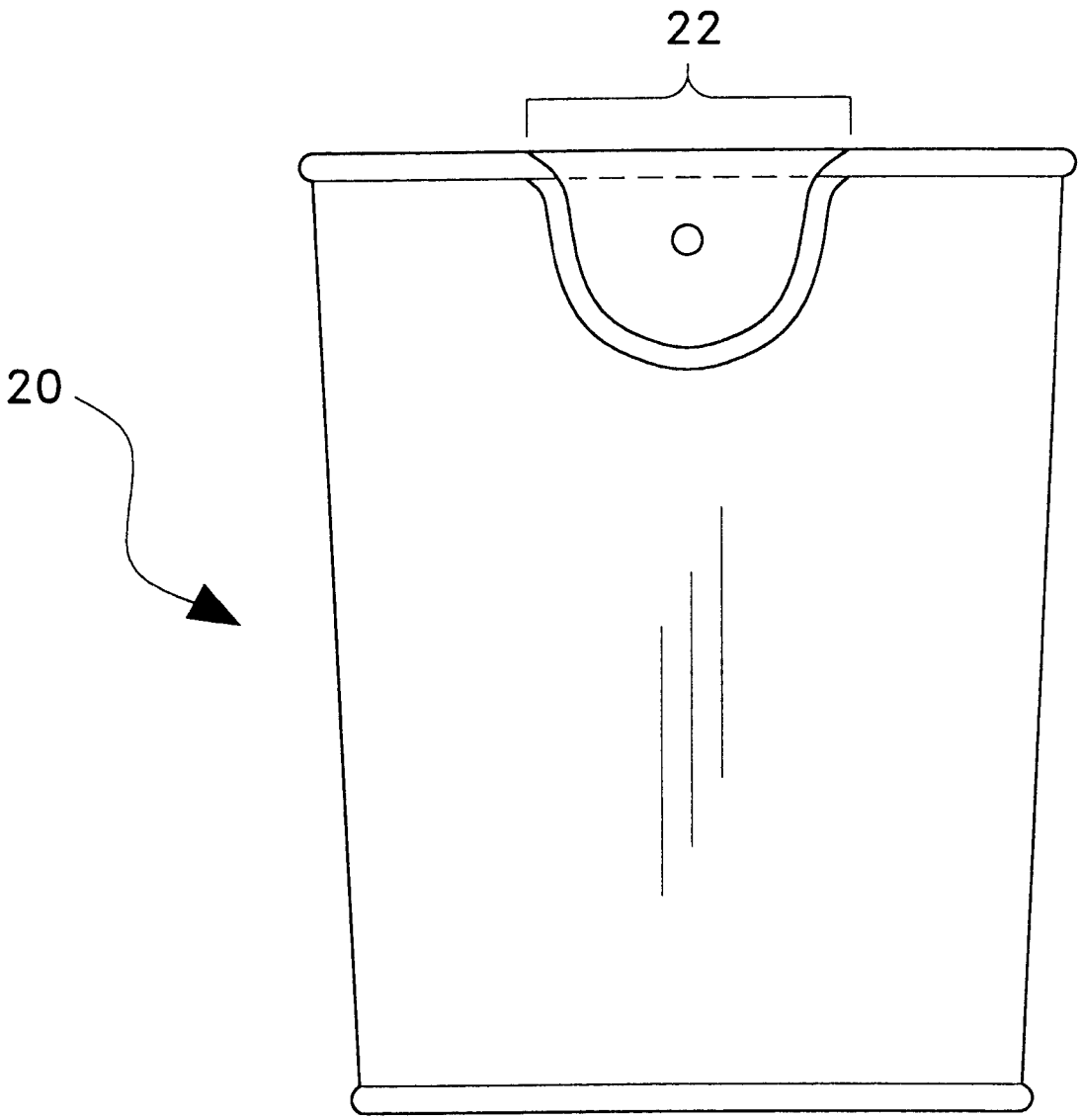
FIG. 3 is a front view of a second embodiment of a yard tool storage device according to the present invention.

FIG. 3 Illustrates a second embodiment 20 of the yard tool storage device. This embodiment has one or more V or U-shaped grooves 22 defined in the top edge of the body 12. The grooves function to allow especially long tools to be more easily inserted into the body 12. This feature is particularly useful in areas with height restrictions, such as low ceilings.

Figure 4:
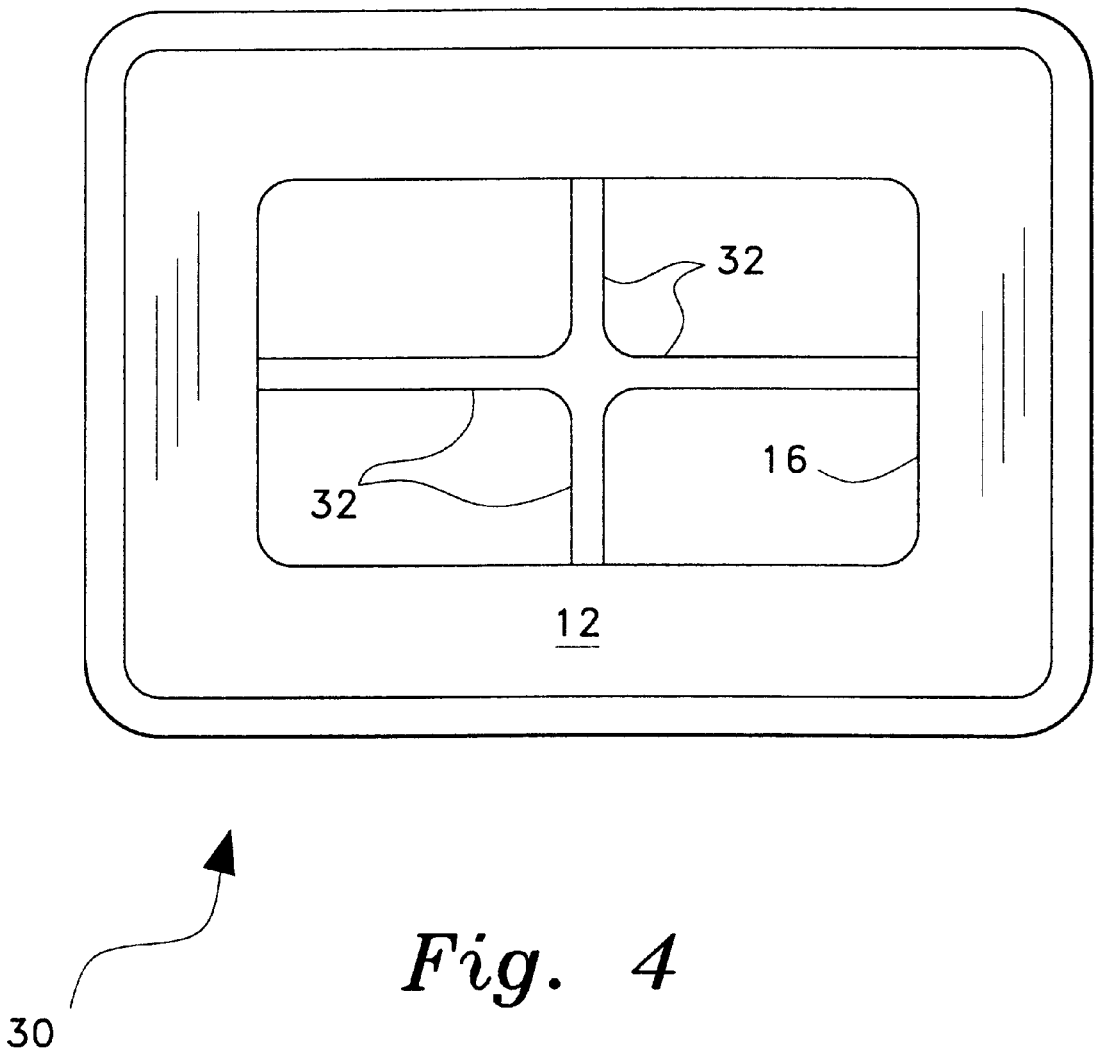
FIG. 4 is an plan view of a third embodiment of a yard tool storage device according to the present invention.

FIG. 4 illustrates a plan view of a third embodiment 30 of the yard tool storage device. In this embodiment support ribs 32 are disposed across the bottom end 16 of the tubular body 12. These ribs 32 function to support the body 12 and further organize tools inserted into the invention.

It is to be understood that the present invention is not limited to the embodiments described above, but encompasses any and all embodiments within the scope of the following claims.

I claim:

1. A yard tool storage device, comprising:

a hollow body having top edge, a bottom edge, a front surface, back surface, and two opposing side surfaces;

a U-shaped groove defined in the front surface of said hollow body;

wherein the top edge and the bottom edge of said body are folded over against said hollow body; and wherein at least two holes are defined in the back surface of said body.

2. A yard tool storage device as in claim 1, wherein:

said hollow body is rectangular in cross section;

the perimeter of the rectangular cross sections of said hollow body decreases from the top edge to the bottom edge of said hollow body; and said front, said back and said opposing side surfaces are, generally flat.

3. A yard tool storage device as in claim 1, wherein:

said hollow body is generally circular in cross section.

4. A yard tool storage device as in claim 1, further comprising:

two intersecting support ribs disposed upon the bottom edge of said hollow body.

5. A yard tool storage device, comprising:

a hollow body having top edge, a bottom edge, a front surface, back surface, and two opposing side surfaces;

wherein the top edge and the bottom edge of said body are folded over against said hollow body;

wherein at least two holes are defined in the back surface said body;

said hollow body is rectangular in cross section;

the perimeter of said hollow body decreases from the top edge to the bottom edge of said hollow body; and said front, said back and said opposing side surfaces are generally flat;

two intersecting support ribs disposed upon the bottom edge of said hollow body; and wherein a U-shaped groove is defined in the front surface of said hollow body.

* * * * *